United States Patent [19]

Knapp et al.

[11] 4,416,238

[45] Nov. 22, 1983

[54] FUEL INJECTION SYSTEM

[75] Inventors: Heinrich Knapp, Leonberg; Rudolf Sauer, Benningen; Rudolf Krauss, Stuttgart; Udo Hafner, Lorch, all of Fed. Rep. of Germany

[73] Assignee: Robert Bosch GmbH, Stuttgart, Fed. Rep. of Germany

[21] Appl. No.: 375,900

[22] Filed: May 7, 1982

[30] Foreign Application Priority Data

May 8, 1981 [DE] Fed. Rep. of Germany ..... 3118168

[51] Int. Cl.[3] ..... F02M 55/00

[52] U.S. Cl. ..... 123/470; 123/516; 239/124; 239/533.2

[58] Field of Search ..... 123/470, 471, 516, 514, 123/468, 469, 467, 472; 239/124, 125, 239/533.2–533.12, 584, 575, 585

[56] References Cited

U.S. PATENT DOCUMENTS 3,125,078 3/1964 Reiners ..... 123/468

4,341,193 7/1982 Bowler ..... 123/516

*Primary Examiner*—William A. Cuchlinski, Jr.

*Assistant Examiner*—Carl Stuart Miller

*Attorney, Agent, or Firm*—Edwin E. Greigg

[57] ABSTRACT

A fuel injection system for injecting fuel into the air intake tube of an internal combustion engine, including at least one fuel injection valve, which is disposed in a holder body and communicates with a fuel supply line and a fuel outflow line. The fuel injection valve is provided with a fuel supply groove, branching off from which are fuel inlet openings, and a fuel outflow groove, leading away from which are fuel outlet openings. The fuel injection valve is guided in the radial direction in a guide opening of the holder body by supporting bodies of a fuel filter which extends axially over the fuel injection valve, covering the fuel supply groove and the fuel outflow groove. The middle supporting body of the fuel filter is embodied such that it seals off the fuel supply line and the fuel supply groove from the fuel outflow line and the fuel outflow groove. In order to carry away vapor bubbles, there is either a degassing conduit embodied on the fuel injection valve between the fuel supply groove and the fuel outflow groove, a degassing conduit embodied on the middle supporting point, or a degassing conduit embodied on the holder body.

3 Claims, 1 Drawing Figure

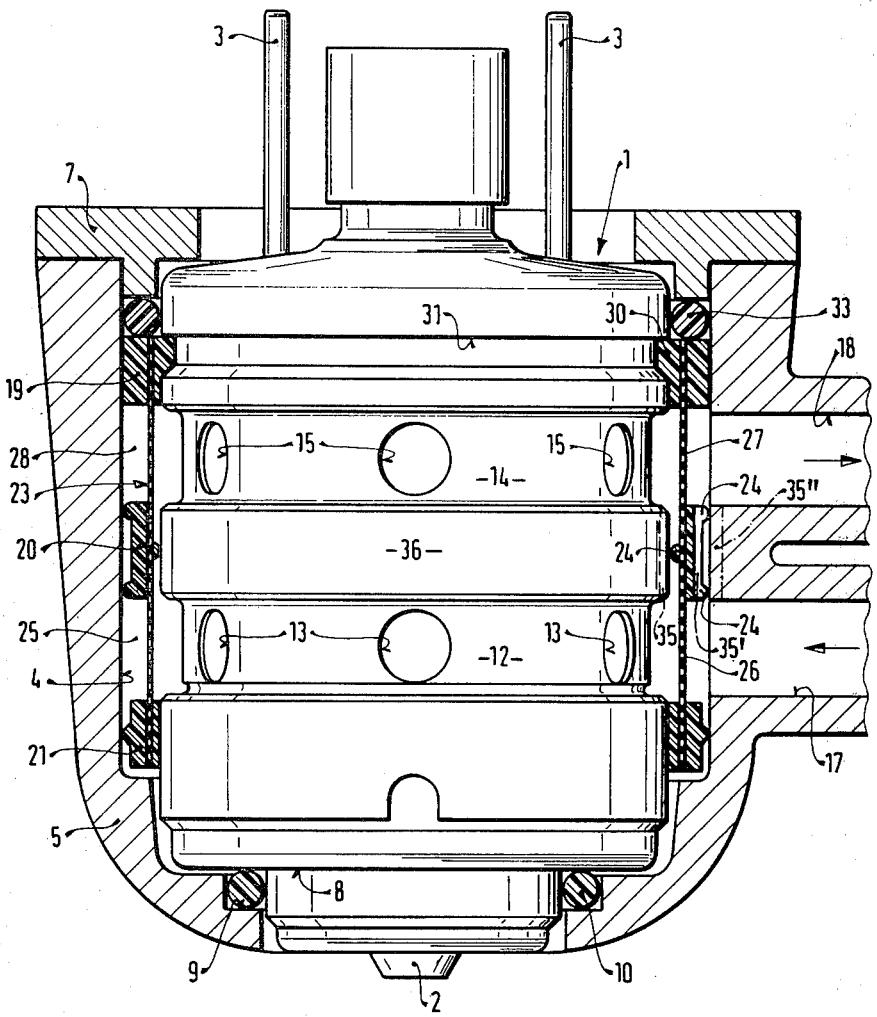
3
3
7
1
31
30
33
18
19
15
15
27
28
-14-
23
24
35''
20
-36-
24
25
13
13
35
24
35'
26
4
-12-
21
17
5
8
9
10
2

FUEL INJECTION SYSTEM

BACKGROUND OF THE INVENTION

The invention relates generally to fuel injection systems for internal combustion engines, and, in particular, to a fuel injection system which includes a fuel injection valve which is disposed within a holder body and a fuel filter which is also disposed within the holder body between fuel inlet openings of the fuel injection valve and a fuel supply line extending through the holder body, and between fuel outlet openings of the fuel injection valve and a fuel overflow line extending through the holder body.

It has already been proposed, in a fuel injection system, to provide a fuel filter between a fuel injection valve and a holder body, the fuel filter covering the fuel inlet and outlet openings of the fuel injection valve; however, this provision is not capable of preventing vapor bubbles carried along via the fuel supply line from entering the fuel injection valve and there causing disturbances in the fuel injection.

OBJECT AND SUMMARY OF THE INVENTION

In the present invention, a fuel injection system similar to the known system described above is provided with a degassing conduit leading from the fuel supply line to the fuel overflow line upstream of the fuel inlet and outlet openings of the fuel injection valve.

The fuel injection system according to the invention has the advantage over the prior art that, besides filtering the fuel flowing into and out of the fuel injection valve, vapor bubbles can travel out of the fuel supply line and into the fuel outflow line without being carried through the injection valve along with the fuel and thereby disturbing the injection process.

It is particularly advantageous to provide a degassing conduit either on the fuel injection valve itself, on the middle supporting body of the fuel filter, or on the holder body of the fuel injection valve.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows an exemplary embodiment of the invention in simplified form.

DESCRIPTION OF THE PREFERRED EMBODIMENT

The fuel injection valve 1 shown in the drawing is electromagnetically actuatable in a known manner and serves, for example, to inject fuel via a mouthpiece 2, in particular at low pressure, into the air intake tube of mixturecompressing internal combustion engines having externally supplied ignition. The fuel injection may be effected either simultaneously for all cylinders of the engine, upstream or downstream of a throttle valve, into the air intake tube by means of a single fuel injection valve 1, or else into the individual air intake tubes directly ahead of each inlet valve of each cylinder of the engine by means of individual fuel injection valves 1 for each air intake tube. The electrical triggering of the fuel injection valve 1 may be effected in a known manner via contact prongs 3. The fuel injection valve 1 is supported in a guide opening 4 of a holder body 5 and may be fixed in the axial direction, for example, by means of a claw or a cap 7; a sealing ring 10 rests on one end face 8 of the fuel injection valve 1, remote from the cap 7, and is supported on the other side on a step 9 of the holder body 5. The holder body 5 may be embodied by the wall of the air intake tube itself or as an independent part. The fuel injection valve 1 has an annular fuel supply groove 12, from which fuel inlet openings 13 lead into the interior of the fuel injection valve 1. The fuel injection valve 1 also has an annular fuel outflow groove 14 axially offset from the fuel supply groove 12 and shown opposite it in the drawing; from the fuel outflow groove 14, fuel outlet openings 15 lead into the interior of the fuel injection valve 1. A fuel supply line 17 discharges into the fuel supply groove 12 and communicates in a manner not shown with a fuel supply source, for instance a fuel pump. The fuel flowing into the fuel supply groove 12 via the fuel supply line 17 passes through the fuel inlet openings 13 into the interior of the fuel injection valve 1 and is either ejected via the mouthpiece 2 or else passes through the fuel injection valve in order to absorb its heat and then exits via the fuel outlet openings 15 into the fuel outflow groove 14, which communicates with a fuel outflow line 18 embodied in the holder body 5. The fuel injection valve 1 is radially guided in the guide opening 4 of the holder body 5 by elastic supporting bodies 19, 20, 21 of a fuel filter 23, which extends in the radial direction, covering the fuel supply groove 12 and the fuel outflow groove 14. The supporting bodies 19, 20 and 21 are fabricated of some elastic material, such as rubber or plastic in particular. The middle supporting body 20 in particular is annularly embodied and is provided by way of example with sealing protrusions 24 such that it is supported on the circumference of the fuel injection valve 1 between the fuel supply groove 12 and the fuel outflow groove 14 on one side and on the guide opening 4 on the other, so that it seals off the fuel supply groove 12 and the fuel supply line 17 from the fuel outflow groove 14 and the fuel outflow line 18. The fuel flowing in via the fuel supply line 17 first reaches an annular groove 25 formed between the middle supporting body 20 and the lower terminal supporting body 21 of the fuel filter, and it can flow out of this annular groove 25 into fuel supply groove 12 via the filter area 26. The fuel can flow out of the fuel outflow groove 14 via the filter area 27 into an annular groove 28 formed between the upper end supporting body 19 and the middle supporting body 20 of the fuel filter 23; this annular groove 28 communicates with the fuel outflow line 18. Particles of soil contained in the fuel are filtered out by the filter areas 26, 27. Particularly because of the elastic embodiment of the middle supporting body 20, simpler machining and greater tolerances on the circumference of the fuel injection valve 1 and in the diameter of the guide opening 4 are attainable. The upper supporting body 19 may be provided on its side oriented toward the fuel injection valve 1 with a detent nose 30, which, when the fuel filter 23 is pushed onto the fuel injection valve comes to rest in a detent groove 31 of the fuel injection valve 1, so that the fuel injection valve 1 can be inserted together with the mounted fuel filter 23 into the guide opening 4 of the holder body 5. A sealing ring 33 may likewise be axially supported on the upper supporting body 19, being disposed between the fuel injection valve 1 and the holder body 5 and fixed on the other end by the cap 7.

Primarily in hot starting of the engine, the danger exists that fuel may vaporize in the fuel lines and in the fuel injection system itself and that the resultant vapor bubbles may be carried through the fuel supply line 17 to the fuel injection valve 1, then being ejected through the opened fuel injection valve 1 instead of liquid fuel, thereby causing rough operation of the engine or even causing the engine to stall. In accordance with the invention, a degassing conduit 35 is therefore provided upstream of the fuel inlet openings 13 and the fuel outlet openings 15. The degassing conduit 35 has a cross section so small that only a small quantity of fuel is capable of flowing back from the fuel supply line 17 to the fuel outflow line 18, yet sufficiently large that vapor bubbles carried along in the fuel supply line 17 are capable of passing through to the fuel outflow line 18 before they can get into the fuel injection valve. The fuel degassing conduit 35 may, as indicated in the drawing by broken lines, be provided in an annular protrusion 36 embodied between the fuel supply groove 12 and the fuel outflow groove 14, so that vapor bubbles which have reached the fuel supply groove 12 can rise through the degassing conduit 35 and into the fuel outflow groove 14, there being carried along by the returning fuel flow into the fuel outflow line 18. Instead of being disposed in the annular protrusion 36, however, the degassing conduit 35' may also be embodied in the middle supporting body 20. A third possibility is indicated in dot-dash lines, where a degassing conduit 35'' leads near the guide opening 4 or directly at the guide opening 4 of the holder body 5 from the fuel supply line 17 to the fuel outflow line 18.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection system for an internal combustion engine which includes an air intake tube, a fuel injection valve for injecting fuel into the air intake tube, the fuel injection valve including:

an axis, an outer or circumferential surface extending about the axis, a fuel inflow groove which extends radially inward from the outer surface of said fuel injection valve and which includes at least one fuel inlet opening therein, a fuel outflow groove which extends radially inward from the outer surface of said fuel injection valve and which is axially offset from said fuel inflow groove by an annular protrusion of said fuel injection valve, said fuel outflow groove including at least one fuel outlet opening therein, a holder body which surrounds the fuel injection valve and includes a guide opening in which the fuel injection valve is disposed, a fuel supply line which opens into the guide opening adjacent the fuel inlet opening of the fuel injection valve, a fuel outflow line which opens into the guide opening adjacent the fuel outlet opening of the fuel injection valve, a fuel filter, which is disposed in the guide opening of the holder body and extends axially to cover the fuel inlet and fuel outlet openings of the fuel injection valve, the fuel filter including a plurality of annular elastic supporting bodies for radially guiding the fuel injection valve in the guide opening of the holder body, wherein the plurality of annular elastic supporting bodies includes a middle supporting body opposite said annular protrusion for sealing off the fuel inlet openings and the fuel supply line from the fuel outlet openings and the fuel outflow line, and a degassing conduit provided in said annular protrusion which leads from the fuel inflow groove to the fuel outflow groove.

2. In a fuel injection system for an internal combustion engine which includes an air intake tube, a fuel injection valve for injecting fuel into the air intake tube, the fuel injection valve including:

an axis, an outer or circumferential surface extending about the axis, a fuel inflow groove which extends radially inward from the outer surface of said fuel injection valve and which includes at least one fuel inlet opening therein, a fuel outflow groove which extends radially inward from the outer surface of said fuel injection valve and which is axially offset from said fuel inflow groove by an annular protrusion of said fuel injection valve, said fuel outflow groove including at least one fuel outlet opening therein, a holder body which surrounds the fuel injection valve and includes a guide opening in which the fuel injection valve is disposed, a fuel supply line which opens into the guide opening adjacent the fuel inlet opening of the fuel injection valve, a fuel outflow line which opens into the guide opening adjacent the fuel outlet opening of the fuel injection valve, a fuel filter, which is disposed in the guide opening of the holder body and extends axially to cover the fuel inlet and fuel outlet openings of the fuel injection valve, the fuel filter including a plurality of annular elastic supporting bodies for radially guiding the fuel injection valve in the guide opening of the holder body, wherein the plurality of annular elastic supporting bodies includes a middle supporting body opposite said annular protrusion for sealing off the fuel inlet openings and the fuel supply line from the fuel outlet openings and the fuel outflow line, and a degassing conduit embodied on the middle supporting body which leads from the fuel supply line to the fuel outflow line.

3. In a fuel injection system for an internal combustion engine which includes an air intake tube, a fuel injection valve for injecting fuel into the air intake tube, the fuel injection valve including:

an axis, an outer or circumferential surface extending about the axis, a fuel inflow groove which extends radially inward from the outer surface of said fuel injection valve and which includes at least one fuel inlet opening therein, a fuel outflow groove which extends radially inward from the outer surface of said fuel injection valve and which is axially offset from said fuel inflow groove by an annular protrusion of said fuel injection valve, said fuel outflow groove including at least one fuel outlet opening therein, a holder body which surrounds the fuel injection valve and includes a guide opening in which the fuel injection valve is disposed, a fuel supply line which opens into the guide opening adjacent the fuel inlet opening of the fuel injection valve, a fuel outflow line which opens into the guide opening adjacent the fuel outlet opening of the fuel injection valve, a fuel filter, which is disposed in the guide opening of the holder body and extends axially to cover the fuel inlet and fuel outlet openings of the fuel injection valve, the fuel filter including a plurality of annular elastic supporting bodies for radially guiding the fuel injection valve in the guide opening of the holder body, wherein the plurality of annular elastic supporting bodies includes a middle supporting body opposite said annular protrusion for sealing off the fuel inlet openings and the fuel supply line from the fuel outlet openings and the fuel outflow line, and a degassing conduit embodied directly along the guide opening in the holder body which leads from the fuel supply line to the fuel outflow line.

* * * * *